US007168698B2

(12) United States Patent
Kawamura et al.

(10) Patent No.: US 7,168,698 B2
(45) Date of Patent: Jan. 30, 2007

(54) SHEET SUCKING/REMOVING METHOD AND SHEET SUCKING/REMOVING DEVICE

(75) Inventors: Yoshinori Kawamura, Kanagawa (JP); Tadanobu Shibabuki, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 41 days.

(21) Appl. No.: 10/807,467

(22) Filed: Mar. 24, 2004

(65) Prior Publication Data

US 2004/0246314 A1 Dec. 9, 2004

(30) Foreign Application Priority Data

Mar. 25, 2003 (JP) ..... 2003-083563

(51) Int. Cl.
*B65H 3/12* (2006.01)

(52) U.S. Cl. ..... 271/96; 271/108; 271/11

(58) Field of Classification Search ..... 271/96, 271/108, 11
See application file for complete search history.

(56) References Cited

U.S. PATENT DOCUMENTS 3,802,696 A * 4/1974 Shigemori et al. ..... 271/107
4,767,113 A * 8/1988 Hasegawa et al. ..... 271/3.15
5,005,823 A * 4/1991 Fyler et al. ..... 271/228
5,143,364 A * 9/1992 Kharzo et al. ..... 271/108
5,984,296 A * 11/1999 Fricke et al. ..... 271/93
6,349,930 B1 * 2/2002 Kruger et al. ..... 271/104
6,439,565 B2 * 8/2002 Gauger et al. ..... 271/12
6,742,779 B2 * 6/2004 Schreier et al. ..... 271/104

FOREIGN PATENT DOCUMENTS

JP 2000-247489 A 9/2000
JP 2001-151360 A 6/2001
JP 2002-128297 A 5/2002

* cited by examiner

*Primary Examiner*—Patrick Mackey
*Assistant Examiner*—Thomas Morrison
(74) *Attorney, Agent, or Firm*—Sughrue Mion, PLLC

(57) ABSTRACT

In a sheet sucking/removing device, suction cups are controlled to a state of a first negative pressure which is a minimum pressure needed to suck and remove only one uppermost printing plate, and sucking/removing is carried out. Thereafter, the suction cups are controlled to a state of a second negative pressure which is needed for conveying and supplying the printing plate, and conveying/supplying of the printing plate is carried out.

10 Claims, 6 Drawing Sheets

SHEET SUCKING/REMOVING METHOD AND SHEET SUCKING/REMOVING DEVICE

CROSS-REFERENCE TO RELATED APPLICATION

This application claims priority under 35 USC 119 from Japanese Patent Application No. 2003-083563, the disclosure of which is incorporated by reference herein.

BACKGROUND OF THE INVENTION

1. Technical Field

The present invention relates to a sheet sucking/feeding device which sucks an uppermost sheet among a plurality of stacked sheets, and separates this uppermost sheet from another sheet therebeneath, and feeds out the uppermost sheet.

2. Description of the Related Art

A technique in which, by using a printing plate (e.g., a PS plate, a thermal plate, a photopolymer plate) in which a recording layer (photosensitive layer) is provided on a support, an image is recorded directly by a laser beam or the like onto the photosensitive layer of the printing plate, has come to be developed as a printing plate exposing device. With this technique, it is possible to quickly record an image onto a printing plate.

In an automatic printing plate exposing device using the technique of recording images onto printing plates, large numbers of printing plates are stacked and accommodated in cassettes. The image forming surface of the printing plate is easily scratched. In order to protect the image forming surface, protective sheets (interleaf sheets) are superposed on the image forming surfaces of the printing plates. Sets of the superposed printing plate and interleaf sheet are successively stacked in layers within the cassette. When a printing plate is to be removed and fed out, one end portion of the uppermost printing plate among the plural printing plates stacked in the cassette is sucked by suction cups so as to separate this printing plate from the others. The printing plates are thereby taken out one-by-one, and are fed sheet-by-sheet (conveyed and fed) to the subsequent process (e.g., an exposure process) while being inverted.

However, when the printing plates are fed out sheet-by-sheet while being sucked by suction cups and taken out one-by-one and inverted as described above, there are cases in which, due static electricity between or sticking due to a vacuum between the uppermost printing plate which the suction cups are sucking and the next printing plate (the printing plate therebeneath), the next printing plate (the printing plate therebeneath) also is lifted up. Therefore, conventionally, a "separating plate" has been provided along the locus of movement along which the printing plate is lifted up and raised while being sucked by the suction cups (e.g., in the corner portion of the top end of the cassette). Due to the printing plate passing by the "separating plate" while contacting the "separating plate" or being temporarily stopped while contacting the "separating plate", the next printing plate (the printing plate therebeneath) is separated therefrom. Refer to Japanese Patent Application Laid-Open (JP-A) Nos. 2002-128297 and 2001-151360.

Here, at the time the printing plate is vacuum-sucked and conveyed by such suction cups, generally, it is sensed by a pressure sensor that the suction pressure has reached a threshold value which is the necessary suction pressure in all of the processes of "sucking and lifting up", "separating by the separating plate so as to remove a single printing plate", and "inverting and conveying", and then the series of sucking/removing operations is started (refer to JP-A No. 2000-247489). In this case, generally, the necessary suction pressure is greatest at the time of the "separating by the separating plate so as to remove a single printing plate".

However, when the printing plate directly beneath the suction cups (i.e., the uppermost printing plate) is sucked by the suction cups, the printing plate follows the configurations of the suction cups and is deformed in concave shapes. Therefore, such deformation of the printing plate (the concavity) as described above newly generates a vacuum between that printing plate and the printing plate therebeneath, and there are cases in which the printing plate positioned at the lower side sticks further to the uppermost printing plate (i.e., the uppermost printing plate and the next printing plate (the printing plate therebeneath) stick together due to the vacuum). This sticking together due to the vacuum similarly proceeds successively to the next printing plate (the printing plate beneath). As a result, there are cases in which several printing plates are sucked together in plural layers. Here, even if plural printing plates are sucked together in plural layers in this way, these next printing plates (i.e., the printing plates beneath) can be separated thereafter by the printing plates contacting the "separating plate" as they pass thereby or contacting the "separating plate" while temporarily stopped.

However, in a conventional sucking/removing device using such suction cups, even if plural printing plates are sucked together in plural layers as described above, ultimately, they must be separated such that the printing plates can be conveyed and supplied one-by-one. However, on the other hand, a suction force (suction negative pressure) which is sufficient to suck plural printing plates (which is sufficient to suck plural printing plates together in plural layers) is needed.

Therefore, the surface area sucked by the suction cups (the size or the number of the suction cups), the capacity of the negative pressure source (e.g., a vacuum pump), or the like must be increased and set so as to be sufficient enough to even suck plural printing plates in plural layers together. This is a cause of an increase in the size of the device and an increase in costs.

SUMMARY OF THE INVENTION

In view of the aforementioned, an object of the present invention is to provide a sheet sucking/removing method and a sheet sucking/removing device which, at the time of sucking and removing an uppermost sheet among a plurality of stacked sheets, can reliably separate this uppermost sheet from the next sheet (the sheet therebeneath) and stably remove the uppermost sheet, and which can keep the surface area sucked by the suction cups (the size and the number of the suction cups) and the capacity of a negative pressure generating source to the minimum needed, and which can enable the device to be made compact and costs to be kept low.

A first aspect of the present invention is a sheet sucking/removing method sucking, by suction cups, an uppermost sheet among a plurality of stacked sheets, and separating the uppermost sheet from another sheet therebeneath, and removing the uppermost sheet, and conveying and supplying the uppermost sheet to a subsequent process, the method comprising the steps of: carrying out the sucking/removing by the suction cups in a first negative pressure state in which a suction negative pressure of the suction cups is a minimum pressure needed in order to suck and remove only the uppermost sheet; and after the sucking/removing, carrying out the conveying/supplying by the suction cups in a second negative pressure state in which the suction negative pressure of the suction cups is a pressure needed for the conveying/supplying.

In the sheet sucking/removing method of the present invention, an uppermost sheet among a plurality of stacked sheets is sucked by suction cups, and is separated from another sheet therebeneath, and is removed, and is conveyed and supplied to a subsequent process.

Here, in the sheet sucking/removing method, the sucking/removing by the suction cups is carried out in a state in which the suction negative pressure of the suction cups is a first negative pressure which is the minimum pressure needed in order to suck and remove only the uppermost sheet. Moreover, after the sucking/removing, the conveying/supplying by the suction cups is carried out in a state in which the suction negative pressure of the suction cups is a second negative pressure which is the pressure needed for the conveying/supplying.

Therefore, at the time when the printing plate directly beneath the suction cups (i.e., the uppermost printing plate) is sucked by the suction cups, the degree by which the printing plate deforms in concave shapes following the configurations of the suction cups can be reduced. Accordingly, it is difficult for a new vacuum to arise between that printing plate and the printing plate therebeneath. It is possible to prevent the printing plate positioned beneath from sticking (i.e., it is possible to prevent vacuum sticking from arising between the uppermost printing plate and the next printing plate (the printing plate therebeneath)). Namely, the occurrence of plural printing plates being sucked in plural layers together can be reduced.

Accordingly, there is no need in the first place for a suction force which is sufficient to suck plural printing plates (i.e., which is sufficient to even suck plural printing plates together in plural layers). There is no need to increase the surface area sucked by the suction cups (the size or the number of the suction cups), or the capacity of the negative pressure generating source (e.g., a vacuum pump), or the like. In this way, the device can be made compact and costs can be reduced.

In this way, in the sheet sucking/removing method of the present invention, at the time when the uppermost sheet among a plurality of the stacked sheets is sucked and removed, the uppermost sheet can be reliably separated from the next sheet (the sheet therebeneath) and stably removed, and the surface area sucked by the suction cups (the size or the number of the suction cups) and the capacity of the negative pressure generating source can be kept to the minimum needed. It is thereby possible to make the device compact and keep costs low.

A second aspect of the present invention is a sheet sucking/removing device which sucks an uppermost sheet among a plurality of stacked sheets, and separates the uppermost sheet from another sheet therebeneath, and removes the uppermost sheet, and conveys and supplies the uppermost sheet to a subsequent process, the device comprising: a plurality of suction cups provided along a transverse direction of the sheet, and sucking/removing the sheet by negative pressure, and conveying/supplying the sheet; a negative pressure generating source connected to the respective suction cups, and generating a first negative pressure which is a minimum pressure needed in order for the respective suction cups to suck and remove only the uppermost sheet, and generating thereafter a second negative pressure needed for the conveying/supplying; and a negative pressure controlling device which can control the suction negative pressure of the respective suction cups to a state of the first negative pressure and a state of the second negative pressure, wherein the suction negative pressure of the respective section cups is controlled to the first negative pressure by the negative pressure controlling device and the sucking/removing is carried out by the respective suction cups, and after the sucking/removing, the suction negative pressure of the respective suction cups is controlled to the second negative pressure by the negative pressure controlling device and the conveying/supplying is carried out by the respective suction cups.

In the sheet sucking/removing device of the present invention, an uppermost sheet among a plurality of stacked sheets is sucked by suction cups, and is separated from another sheet therebeneath, and is removed, and is conveyed and supplied to a subsequent process.

Here, in the sheet sucking/removing device, the suction negative pressure of the respective suction cups is controlled by the negative pressure controlling device to the first negative pressure (i.e., the minimum pressure needed in order to suck and remove only the uppermost sheet), and in this state, the sucking/removing is carried out by the respective suction cups. Further, after the sucking/removing, the suction negative pressure of the respective suction cups is controlled by the negative pressure controlling device to the second negative pressure (i.e., the pressure needed for conveying/supplying), and in this state, the conveying/supplying is carried out by the respective suction cups.

Therefore, at the time when the printing plate directly beneath the suction cups (i.e., the uppermost printing plate) is sucked by the suction cups, the degree by which the printing plate deforms in concave shapes following the configurations of the suction cups can be reduced. Accordingly, it is difficult for a new vacuum to arise between that printing plate and the printing plate therebeneath. It is possible to prevent the printing plate positioned beneath from sticking (i.e., possible to prevent vacuum sticking from arising between the uppermost printing plate and the next printing plate (the printing plate therebeneath)). Namely, the occurrence of plural printing plates being sucked together in plural layers can be reduced.

Accordingly, there is no need in the first place for a suction force which is sufficient to suck plural printing plates (i.e., which is sufficient to even suck plural printing plates together in plural layers), and there is no need to increase the surface area sucked by the suction cups (the size or the number of the suction cups), or the capacity of the negative pressure generating source (e.g., a vacuum pump), or the like. In this way, the device can be made compact and costs can be reduced.

In this way, in the sheet sucking/removing device of the present invention, at the time when the uppermost sheet among a plurality of stacked sheets is sucked and removed, the uppermost sheet can be reliably separated from the next sheet (the sheet therebeneath) and stably removed, and the surface area sucked by the suction cups (the size or the number of the suction cups) and the capacity of the negative pressure generating source can be kept to the minimum needed. It is thereby possible to make the device compact and keep costs low.

DETAILED DESCRIPTION OF THE INVENTION

First Embodiment

Figure 3:
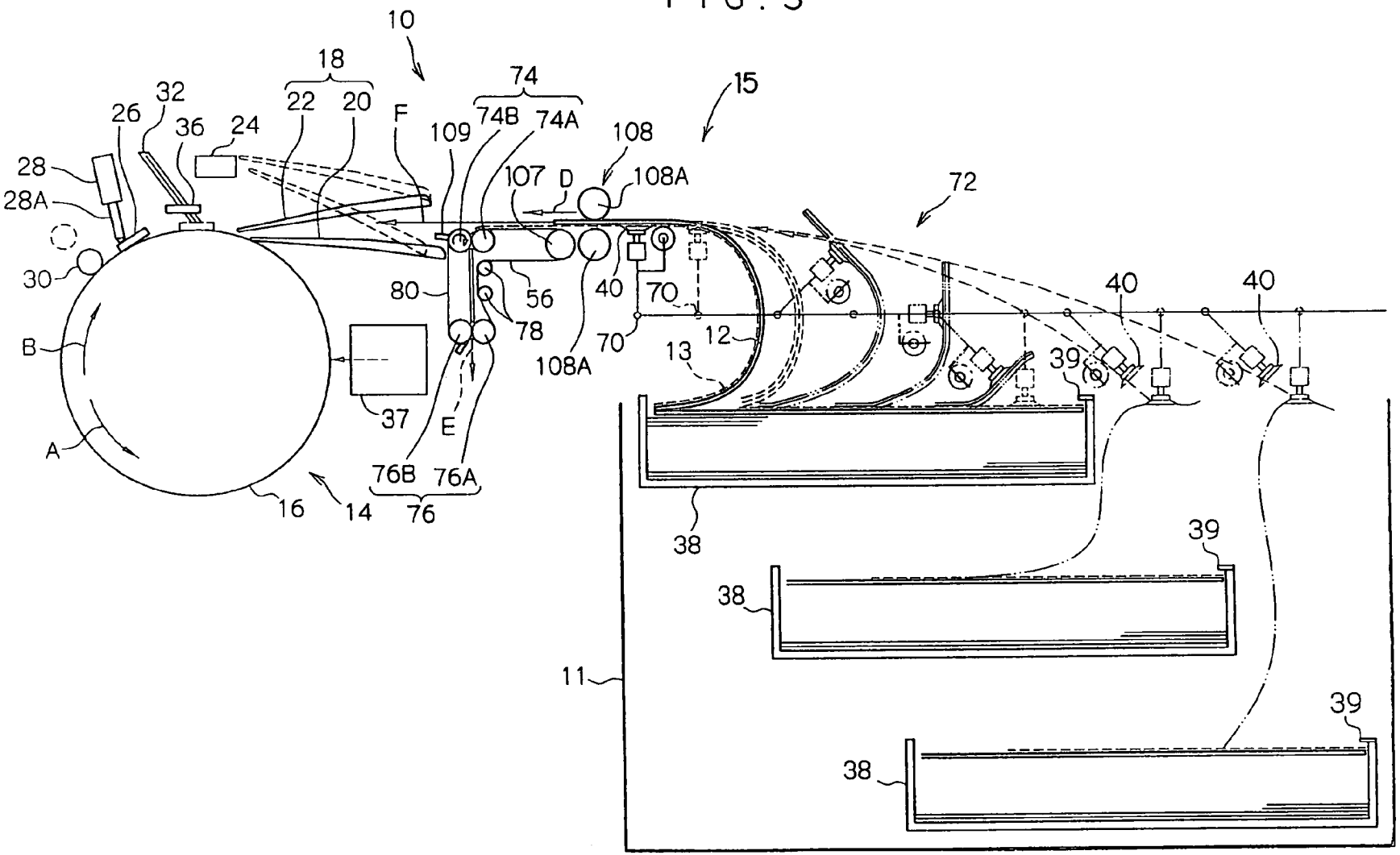
FIG. 3 is a schematic diagram of an automatic printing plate exposing device to which the sucking/removing device relating to the first embodiment of the present invention is applied.

The schematic overall structure of an automatic printing plate exposing device 10, to which a sheet sucking/feeding device 50 relating to a first embodiment of the present invention is applied, is shown in FIG. 3.

The automatic printing plate exposing device 10 is divided into two main sections which are an exposure section 14, which illuminates a light beam onto an image forming layer of a printing plate 12 so as to expose an image, and a sheet feeding/conveying section 15 which removes the printing plate 12 and conveys the printing plate 12 to the exposure section 14. The printing plate 12, which has been subjected to exposure processing by the automatic printing plate exposure device 10, is fed out to a developing device (not illustrated) which is disposed adjacent to the automatic printing plate exposure device 10.

Structure of Exposure Section

The exposure section 14 is structured such that a rotating drum 16, around whose peripheral surface the printing plate 12 is trained and held, is the main portion of the exposure section 14. The printing plate 12 is guided by a conveying guide unit 18, and is fed in from a direction tangent to the rotating drum 16. The conveying guide unit 18 is structured by a plate supplying guide 20 and a plate discharging guide 22. Conveying rollers 108 and a guide plate 109 are disposed at the side of the conveying guide unit 18 which side borders on the sheet feeding/conveying section 15.

The relative positional relationship of the plate supplying guide 20 and the plate discharging guide 22 of the conveying guide unit 18 is such that the plate supplying guide 20 and the plate discharging guide 22 form a sideways V shape. The plate supplying guide 20 and the plate discharging guide 22 rotate by predetermined angles around the right end portion sides thereof in FIG. 3. Due to this rotation, the plate supplying guide 20 can be selectively disposed at a position corresponding to the rotating drum 16 (a position of being disposed in a direction tangent to the rotating drum 16), and a position of inserting the printing plate 12 into a puncher 24 which is provided above the rotating drum 16. The printing plate 12 which has been fed in from the sheet feeding/conveying section 15 is first guided by the plate supplying guide 20 and fed into the puncher 24 where notches for positioning are formed in the leading end of the printing plate 12. Further, after the printing plate 12 undergoes processing at the puncher 24 as needed, the printing plate 12 is returned to the plate supplying guide 20. The printing plate 12 is thereby moved to a position corresponding to the rotating drum 16.

The rotating drum 16 is rotated by an unillustrated driving means in a direction in which the printing plate 12 is attached and exposed (the direction of arrow A in FIG. 3), and in a direction in which the printing plate 12 is removed (the direction of arrow B in FIG. 3) which is opposite to the attaching/exposing direction.

Leading end chucks 26 are mounted to predetermined positions of the outer peripheral surface of the rotating drum 16. At the exposure section 14, when the printing plate 12 is to be attached to the rotating drum 16, first, the rotating drum 16 is stopped at a position (printing plate attaching position) at which the leading end chucks 26 oppose the leading end of the printing plate 12 which has been fed in by the plate supplying guide 20 of the conveying guide unit 18.

An attaching unit 28 is provided in the exposure section 14 so as to oppose the leading end chucks 26 at the printing plate attaching position. Due to extending/retracting rods 28A of the attaching unit 28 extending and one end sides of the leading end chucks 26 being pressed, the printing plate 12 can be inserted between the leading end chucks 26 and the peripheral surface of the rotating drum 16. In the state in which the leading end of the printing plate 12 is inserted between the leading end chucks 26 and the rotating drum 16, the extending/retracting rods 28A of the attaching unit 28 are pulled back such that their pressing of the leading end chucks 26 is released. In this way, the leading end of the printing plate 12 is nipped and held between the leading end chucks 26 and the peripheral surface of the rotating drum 16. At this time, the printing plate 12 is positioned due to the leading end thereof abutting positioning pins (not shown) provided on the rotating drum 16. When the leading end of the printing plate 12 is fixed to the rotating drum 16, the rotating drum 16 is rotated in the attaching/exposing direction. In this way, the printing plate 12, which has been fed in from the plate supplying guide 20 of the conveying guide unit 18, is trained about the peripheral surface of the rotating drum 16.

A squeeze roller 30 is provided at the downstream side, in the attaching/exposing direction (the direction of arrow A in FIG. 3), of the printing plate attaching position, in a vicinity of the peripheral surface of the rotating drum 16. Due to the squeeze roller 30 moving toward the rotating drum 16, the printing plate 12 which is trained on the rotating drum 16 is pushed toward the rotating drum 16 and is made to fit tightly to the peripheral surface of the rotating drum 16.

Further, a trailing end chuck attaching/detaching unit 32 is disposed in the exposure section 14 in a vicinity of the upstream side of the leading end chucks 26 in the attaching/exposing direction of the rotating drum 16. At the trailing end chuck attaching/detaching unit 32, trailing end chucks 36 move along guides which project out toward the rotating drum 16. When the trailing end of the printing plate 12 which is trained on the rotating drum 16 opposes the trailing end chuck attaching/detaching unit 32, the trailing end chucks 36 are moved toward the rotating drum 16 and attached to predetermined positions of the rotating drum 16. In this way, the trailing end of the printing plate 12 is nipped and held between the trailing end chucks 36 and the rotating drum 16.

When the leading end and the trailing end of the printing plate 12 are held at the rotating drum 16, the squeeze roller 30 is moved away (refer to the chain line in FIG. 3). Thereafter, in the exposure section 14, while rotating the rotating drum 16 at high speed at a predetermined rotational speed, a light beam, which is modulated on the basis of image data, is irradiated from a recording head portion 37 synchronously with the rotation of the rotating drum 16. In this way, the printing plate 12 is scan-exposed on the basis of the image data.

When the scan-exposure of the printing plate 12 has been completed, the rotating drum 16 is temporarily stopped at a position at which the trailing end chucks 36, which are holding the trailing end of the printing plate 12, oppose the trailing end chuck attaching/detaching unit 32. The trailing end chuck attaching/detaching unit 32 removes the trailing end chucks 36 from the rotating drum 16. In this way, the trailing end of the printing plate 12 is freed. Thereafter, by rotating the rotating drum 16 in the direction of removing the printing plate 12, the printing plate 12 is expelled, from the trailing end side thereof, to the plate discharging guide 22 of the conveying guide unit 18 along a direction tangent to the rotating drum 16. Thereafter, the printing plate 12 is conveyed to the developing device which is the subsequent process.

Structure of Sheet Feeding/Conveying Section 15

Figure 4:
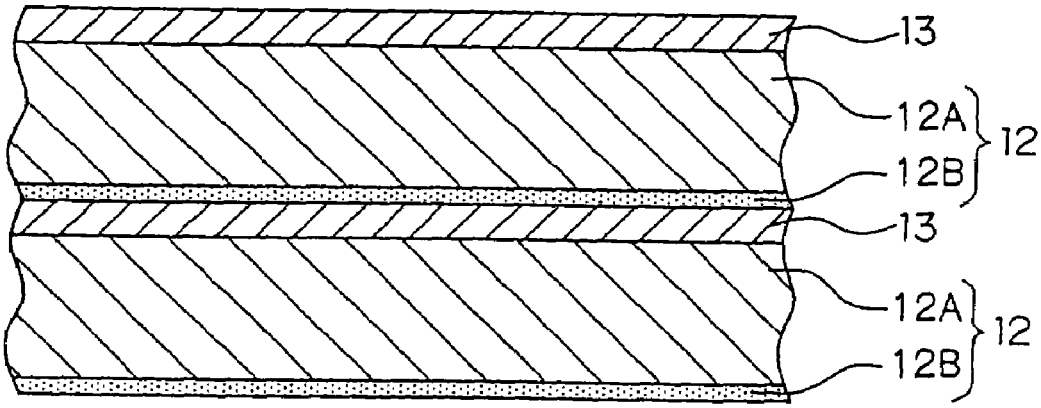
FIG. 4 is a cross-sectional view showing a state in which interleaf sheets and printing plates, which are sucked by the sucking/removing device relating to the first embodiment of the present invention, are stacked within a cassette.

As shown in FIG. 3, a cassette stacking section 11 occupying a predetermined space is provided in the sheet feeding/conveying section 15. Cassettes 38, which are parallel to the surface on which the device is placed, are provided in the cassette stacking section 11. A plurality of cassettes 38 are provided one above the other at plural levels. A plurality of the printing plates 12 are accommodated in each of the cassettes 38. As shown in FIG. 4, the printing plates 12 are structured such that an emulsion surface 12B (image recording surface) is formed on a support 12A. Interleaf sheets 13, which are protective sheets for protecting the emulsion surfaces 12B of the printing plates 12, and the printing plate 12, which are disposed such that their emulsion surfaces 12B face downwardly, are accommodated within the cassette 38 so as to be stacked alternately.

Here, the cassettes 38 in the present embodiment are stacked one above the other so as to be offset from one another in the horizontal direction. The amounts of offset are set on the basis of the loci of movement at the time when the printing plates 12 (and the interleaf sheets 13 which are protective sheets) are carried out from the cassettes 38 by suction cups 40 of a sucking/feeding device 50 which will be described later.

The sucking/feeding device 50 which will be described in detail later is provided in the sheet feeding/conveying section 15. In the sucking/feeding device 50, a plurality of the suction cups 40 (in this embodiment, nine suction cups) are disposed at predetermined pitch intervals along the transverse direction of the printing plate 12. The suction cups 40 are classified into a plurality of systems. By selecting a system on the basis of the size of the printing plate 12 and imparting a sucking function to the selected system, the printing plate 12 can be sucked in a well-balanced manner.

A moving mechanism 72 is provided above the cassettes 38. In the moving mechanism 72, the suction cups 40 are supported so as to hang downward, and base points 70, which support the suction cups 40 in this downward hanging state, are movable substantially horizontally in the left-right direction of the cassettes 38 in FIG. 3. The moving mechanism 72 is a structure for moving the sucking/feeding device 50 in the horizontal direction while inverting the sucking/feeding device 50. The base points 70 which support the plural suction cups 52 are rotatable.

When the printing plate 12 is to be carried out from the cassette 38 by the sucking/feeding device 50, because the interleaf sheets 13 and the printing plates 12, whose emulsion surfaces 12B are facing downward, are stacked alternately in the cassette 38, the suction cups 40 contact the interleaf sheet 13 which is the topmost layer within the cassette 38. When suction force is imparted to the suction cups 40 at the point in time when they contact the uppermost interleaf sheet 13, the suction force is applied to the uppermost interleaf sheet 13, and is transferred as well as to the printing plate 12 immediately therebeneath. The interleaf sheet 13 and the printing plate 12 are thereby sucked and lifted up (together and simultaneously) as a pair (as one set). Although the raising and lowering of the suction cups 40 is omitted from illustration in FIG. 3, the suction cups 40 are lowered to the heightwise position of each cassette 38, and separate (disjoin) the interleaf sheet 13 and the printing plate 12, which are other than and which are beneath the interleaf sheet 13 and the printing plate 12 which are being sucked, by a "separating operation" which will be described in detail later, and are raised to their topmost positions in this state.

At this time, in the vertical direction lifting out of the printing plates 12 from the cassettes 38 of the respective levels, there are different loci of movement due to the lengths (left-right direction lengths in FIG. 3) of the printing plates 12. Namely, in a case in which three levels of the cassettes 38 are provided as in the present embodiment, when the printing plate 12 is lifted up out from the uppermost cassette 38, only the leading end portion of the printing plate 12 is lifted up. When the printing plate 12 is to be lifted up out from the middle cassette 38, about ⅔ of the printing plate 12 is lifted up. When the printing plate 12 is to be lifted up out from the lowermost cassette 38, the entire printing plate 12 is in a state of being suspended downward.

In this state, a plate which supports the suction cups 40 begins to rotate counterclockwise in FIG. 3 around the base points 70, and begins to move toward the left, in FIG. 3, of the cassettes 38. In this way, the suction points of the suction cups 40 move while tracing a so-called cycloid curve. The amounts by which the respective cassettes 38 are offset are set on the basis of the loci of movement. Therefore, regardless of which cassette 38 the printing plate 12 and the interleaf sheet 13 are lifted out from, the printing plate 12 and the interleaf sheet 13 can be lifted out without being interfered with by the cassettes 38 thereabove.

Note that there is usually absolutely no interference between the printing plate 12 and the cassettes 38 thereabove. However, the surface abutting the cassette 38 is the interleaf sheet 13 (the reverse surface side of the printing plate 12). Therefore, assuming that the space, as seen in plan view, of the cassette stacking section 11 is made to be small, the printing plate 12 may slightly contact the cassette 38 when the suction cups 40 are moving in the left-right direction (the horizontal direction), provided that contact at the time when the suction cups 40 are moving in the raising/lowering direction (the vertical direction) and are being rotated is avoided.

When the suction cups 40 have been rotated by 180°, the interleaf sheet 13 is now at the lower side and the printing plate 12 is now at the upper side in the state shown in FIG. 3, and the interleaf sheet 13 and the printing plate 12 are transferred to the conveying rollers 108.

A belt 56 is trained around a roller 107 which is adjacent to a roller 108A which is the lower roller of the conveying rollers 108. The belt 56 is also trained around a right roller 74A of a pair of rollers 74 which are disposed in a vicinity of the conveying guide unit 18 of the exposure section 14. A pair of rollers 76 is provided beneath the pair of rollers 74. The belt 56 is trained around a right side roller 76A of the lower rollers 76, and along a pair of small rollers 78 so as to form a substantially L-shaped loop overall. The belt 56 is driven in the direction of arrow D in FIG. 3.

A belt 80 spans between a left side roller 74B of the upper pair of rollers 74 and a left side roller 76B of the lower pair of rollers 76.

The roller 74B is a roller which rotates in the direction opposite to the conveying direction. The frictional force between the roller 74B and the interleaf sheet 13 is great. During the time of usual conveying, the roller 74B is withdrawn beneath the plane of conveying. After the printing plate 12 and the interleaf sheet 13 have passed above the roller 74B, the roller 74B is raised. Due to the frictional force, the interleaf sheet 13 is pulled in between the rollers 74, and the roller 74B is then withdrawn. The interleaf sheet 13 is fed to the lower rollers 76 and discarded (refer to the chain line arrow E in FIG. 3).

The printing plate 12 passes above the upper pair of rollers 74 and is fed to the plate supplying guide 20 (refer to the solid-line arrow F in FIG. 3).

Structure of Sucking/Feeding Device 50

Figure 2:
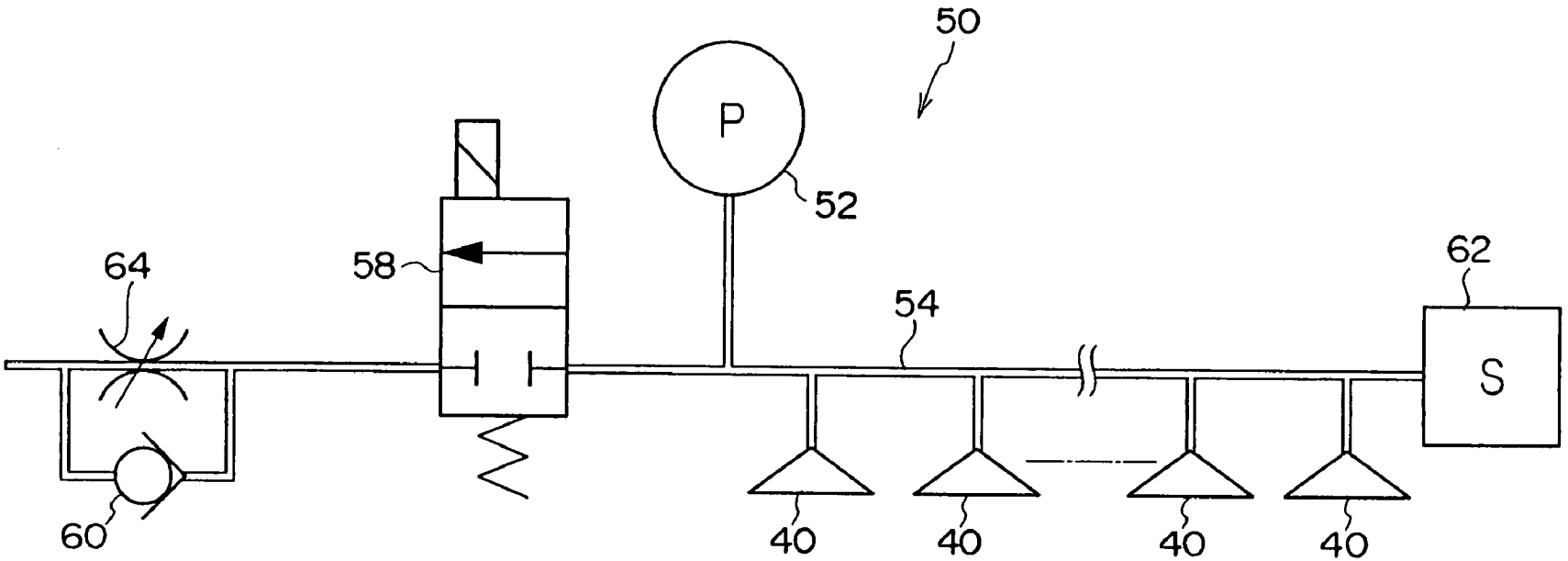
FIG. 2 is an overall structural view of the sucking/removing device relating to the first embodiment of the present invention.

The structure of the sucking/feeding device 50 relating to the present first embodiment is shown in perspective view in FIG. 2.

At the sucking/feeding device 50, the plural suction cups 40 are disposed at predetermined intervals at a base plate 52 which is provided along the transverse direction of the printing plate 12. Note that, in FIG. 2, only four suction cups 40 are illustrated.

The heightwise dimension of the concave portion (the so-called "pool of air") of the skirt portion of each suction cup 40 is set so as to be relatively small, such that the extent of deformation at the time when the suction cup 40 sucks the printing plate 12 is small. The suction cups 40 are connected, via a conduit 54, to a vacuum pump 52 which serves as a negative pressure generating source. The vacuum pump 52 is a reciprocating movement type using a piston and a diaphragm. The vacuum pump 52 generates the negative pressure needed for the respective suction cups 40 to suck and remove the printing plate 12, and the negative pressure needed to convey and supply the printing plate 12 thereafter.

Further, an electromagnetic two-way type valve 58 which forms a negative pressure control device, and a variable throttle valve 64 equipped with a check valve 60, are connected to the conduit 54. The suction negative pressure of the conduit 54 (the suction cups 40) can be opened to the atmosphere within a range in which the respective suction cups 40 can suck the printing plate 12.

Figure 1:
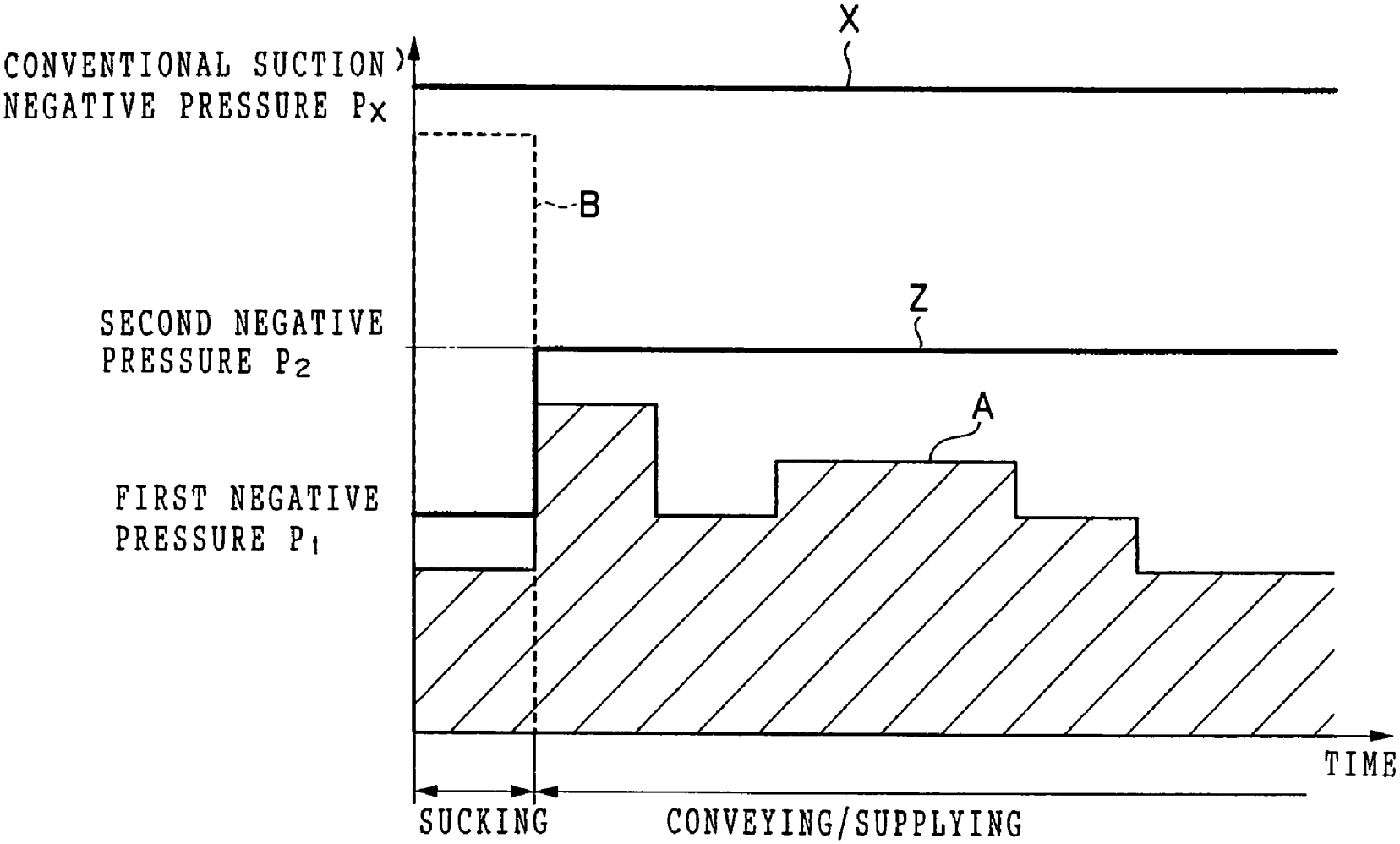
FIG. 1 is a graph showing, in comparison with the conventional art, the state of suction negative pressure of suction cups at the time of sucking/removing and at the time of conveying/supplying of a sucking/removing device relating to a first embodiment of the present invention.

Moreover, a pressure detecting sensor (switch) 62 is connected to the conduit 54. As shown in FIG. 1, the pressure detecting sensor 62 can detect a first negative pressure $P_1$ which is the minimum pressure required for the suction cups 40 to suck and remove only the uppermost printing plate 12 (only one of the printing plates 12), and a second negative pressure $P_2$ needed for conveying/supplying the printing plate 12 after the sucking/removing.

In this way, at the time when the suction cups 40 suck and remove the printing plate 12, the suction negative pressure of the suction cups 40 is detected by the pressure detecting sensor 62, the electromagnetic two-way type valve 58 is operated, and the suction negative pressure of the suction cups 40 (the conduit 54) is opened to the atmosphere. In this way, the suction negative pressure of the suction cups 40 is set to be the first negative pressure $P_1$ which is the minimum pressure required for the suction cups 40 to suck and remove only the uppermost printing plate 12. Further, at the time of conveying/supplying the printing plate 12 after the sucking/removing, the suction negative pressure of the suction cups 40 is set to be the second negative pressure $P_2$ which is required for the conveying/supplying.

In other words, when the printing plate 12 is sucked and removed by the suction cups 40, in order for the suction negative pressure to become the first negative pressure $P_1$, the electromagnetic two-way type valve 58 is operated, and the suction negative pressure of the suction cups 40 (the conduit 54) is opened to the atmosphere. At the time of conveying/supplying the printing plate 12 after the sucking/removing, in order for the suction negative pressure to become the second negative pressure $P_2$, similarly, the electromagnetic two-way type valve 58 is operated, and the opening to the atmosphere of the suction negative pressure of the suction cups 40 (the conduit 54) is stopped.

Note that an analog output type sensor may be used as the pressure detecting sensor 62, and the first negative pressure $P_1$ and the second negative pressure $P_2$ may be set by the control device (the control circuit) of the sucking/removing device 50.

Next, operation of the present first embodiment will be described.

At the automatic printing plate exposing device 10 having the above-described structure, when the printing plate 12 (and the interleaf sheet 13) are to be taken out from the cassette 38, one of the cassettes 38, which are placed one above the other in plural levels, is specified. When the cassette 38 is specified, the suction cups 40 are positioned in a vicinity of the right end portion (in FIG. 4) of the specified cassette 38. After positioning, the sucking/feeding device 50 (the suction cups 40) is lowered to the heightwise position of the cassette 38. Although the heightwise positions of the cassettes 38 are respectively different, in each case, the movement of the sucking/feeding device 50 is simple, rectilinear movement.

When the sucking/feeding device 50 is lowered, the suction cups 40 contact the interleaf sheet 13 which is the uppermost material in the specified cassette 38. In this state, sucking by the suction cups 40 is started, and a predetermined amount of negative pressure is generated. With this negative pressure, the suction cups 40 suck the printing plate 12 together with the uppermost interleaf sheet 13. After sucking, the suction cups 40 start moving upward and the printing plate 12 touches a separator 39. The following (or lower) interleaf sheets and printing plates are successfully separated from the sucked printing plate 12. Only the uppermost interleaf sheet 13 and the sucked printing plate 12 are removed from the cassette 38 and conveyed to a next process.

When the suction cups 40 of the sucking/feeding device 50 lift the printing plate 12 (and the interleaf sheet 13) up out of the cassette 38 and reach their topmost positions, the suction cups 40 move horizontally toward the exposure section 14 while rotating 180° around the base points 70. At this time, the printing plate 12 pick-up positions (the points at which the printing plate 12 is sucked by the suction cups 40) move while tracing a so-called cycloid curve. Thus, the printing plate 12 (and the interleaf sheet 13), which have been lifted up out of one of the lower-level cassettes 38 and which intrinsically have a given amount of stiffness, are conveyed while circling around the cassettes 38 thereabove. Thus, there is hardly any contact of the printing plate 12 (and the interleaf sheet 13) with the cassettes 38 thereabove. Note that, because the portion of the printing plate 12 which may contact the cassettes 38 thereabove is the reverse surface side of the printing plate 12, some contact is permitted.

The printing plate 12 (and the interleaf sheet 13) which have been rotated by 180° are transferred to the conveying rollers 108. The interleaf sheet 13 is peeled off from the printing plate 12 by the roller 74B which rotates in the direction opposite to the conveying direction. The peeled-off interleaf sheet 13 is pulled in between the rollers 74, is fed to the lower rollers 76, and is discarded in the unillustrated discard box.

The printing plate 12 continues to be conveyed substantially horizontally on the guide plate 109, and is fed to the plate supplying guide 20. The printing plate 12 on the plate supplying guide 20 is fed to the rotating drum 16, and the leading end portion of the printing plate 12 is held by the leading end chucks 26. In this state, due to the rotating drum 16 rotating, the printing plate 12 is trained tightly onto the peripheral surface of the rotating drum 16. Thereafter, the trailing end of the printing plate 12 is held by the trailing end chucks 36. Preparations for exposure are thereby completed.

In this state, image data is read, and exposure processing by the light beam from the recording head portion 37 is started. The exposure processing is so-called scan-exposure in which the recording head portion 37 is moved in the axial direction of the rotating drum 16 while the rotating drum 16 is rotated at high speed (main scanning).

When exposure processing is completed, the conveying guide unit 18 is switched (the plate discharging guide 22 is made to correspond to the rotating drum 16). Next, the printing plate 12 which is trained on the rotating drum 16 is discharged out from a direction tangent to the rotating drum 16. At this time, the printing plate 12 is fed to the plate discharging guide 22. When the printing plate 12 is fed to the plate discharging guide 22, the conveying guide unit 18 is switched such that the plate discharging guide 22 is made to correspond to the discharge opening, and the printing plate 12 is discharged. The developing section is provided in the discharging direction, and thus, the printing plate 12 is then subjected to developing processing.

When the printing plate 12 is vacuum-sucked by the suction cups 40 and is conveyed one sheet at a time as described above, the load applied to the suction cups 40 successively changes throughout all of the processes of "sucking and lifting up", "separating by the separating plate so as to remove a single printing plate", and "inverting and conveying", as is shown by line A in FIG. 1. However, generally, the load is the greatest at the time of "separating by the separating plate so as to remove a single printing plate".

Here, conventionally, even if plural printing plates 12 were sucked together in plural layers, ultimately, the printing plates 12 were separated such that the printing plates 12 could be conveyed and supplied one-by-one. However, on the other hand, as shown by line B in FIG. 1, if plural printing plates 12 were sucked together in plural layers, the load applied to the suction cups 40 at that time was great. Accordingly, as shown by line X in FIG. 1, there was the need for a suction force (suction negative pressure $P_X$) sufficient to suck plural printing plates 12 (a suction force which was sufficient to even suck plural printing plates 12 together in plural layers). Therefore, the surface area sucked by the suction cups 40 (i.e., the size or the number of the suction cups 40) or the capacity of the negative pressure source (the vacuum pump 52) had to be great, and had to be set to be sufficient to even suck plural printing plates 12 together in plural layers. This was a cause of the device becoming large and costs increasing.

In contrast, in the sucking/removing device 50 relating to the present embodiment, as described above, when the interleaf sheet 13 and the printing plate 12 in the cassette 38 are sucked and removed by the suction cups 40, the suction negative pressure of the suction cups 40 is detected by the pressure detecting sensor 62. As shown by line Z in FIG. 1, the suction negative pressure is controlled to be the first negative pressure $P_1$ which is the minimum required for the suction cups 40 to suck and remove only the uppermost printing plate 12. Namely, due to the operation of the electromagnetic two-way type valve 58, the suction negative pressure of the suction cups 40 (the conduit 54) is opened to the atmosphere, and thereby becomes the first negative pressure $P_1$. In this state, the sucking and removing by the suction cups 40 is carried out. Moreover, at the time of conveying/supplying the printing plate 12 after the sucking/removing, in the same way, the suction negative pressure of the suction cups 40 is detected by the pressure detecting sensor 62. The electromagnetic two-way type valve 58 is operated and the suction negative pressure of the suction cups 40 (the conduit 54) is controlled such that the suction negative pressure of the suction cups 40 becomes the second negative pressure $P_2$ needed for conveying/supplying. In this state, the conveying and supplying by the suction cups 40 is carried out.

Therefore, at the time when the printing plate 12 directly beneath the suction cups 40 (i.e., the uppermost printing plate 12) is sucked by the suction cups 40, the extent by which the printing plate 12 deforms in concave shapes following the configurations of the suction cups 40 can be reduced. Accordingly, it is difficult for a new vacuum to arise between that printing plate 12 and the printing plate 12 therebeneath. It is possible to prevent the printing plate 12 positioned beneath from sticking (i.e., possible to prevent vacuum sticking from arising between the uppermost printing plate 12 and the next printing plate 12 (the printing plate 12 therebeneath)). Namely, the occurrence of plural printing plates 12 being sucked in plural layers together can be reduced.

Accordingly, there is no need in the first place for a suction force (suction negative pressure $P_X$) which is sufficient to suck plural printing plates 12 as shown by line X in FIG. 1 (i.e., which is sufficient to even suck plural printing plates 12 together in plural layers). In other words, it suffices to generate the second negative pressure $P_2$ which is much lower than the suction negative pressure $P_X$, and there is no need to increase the surface area sucked by the suction cups 40 (the size or the number of the suction cups 40), or the capacity of the vacuum pump 52 (the negative pressure generating source), or the like. In this way, the device can be made compact and costs can be reduced.

In this way, in the sucking/removing device 50 relating to the first embodiment, at the time when the uppermost printing plate 12 among a plurality of the stacked printing plates 12 is sucked and removed, the uppermost printing plate 12 can be reliably separated from the next printing plate 12 (the printing plate 12 therebeneath) and stably removed, and the surface area sucked by the suction cups 40 (the size or the number of the suction cups 40) and the capacity of the vacuum pump 52 (the negative pressure generating source) can be kept to the minimum needed. It is possible to make the device compact and keep costs low.

Next, another embodiment of the present invention will be described.

Note that parts which are basically the same as those in the above-described first embodiment are denoted by the same reference numerals as in the first embodiment, and description thereof is omitted.

Second Embodiment

Figure 5:
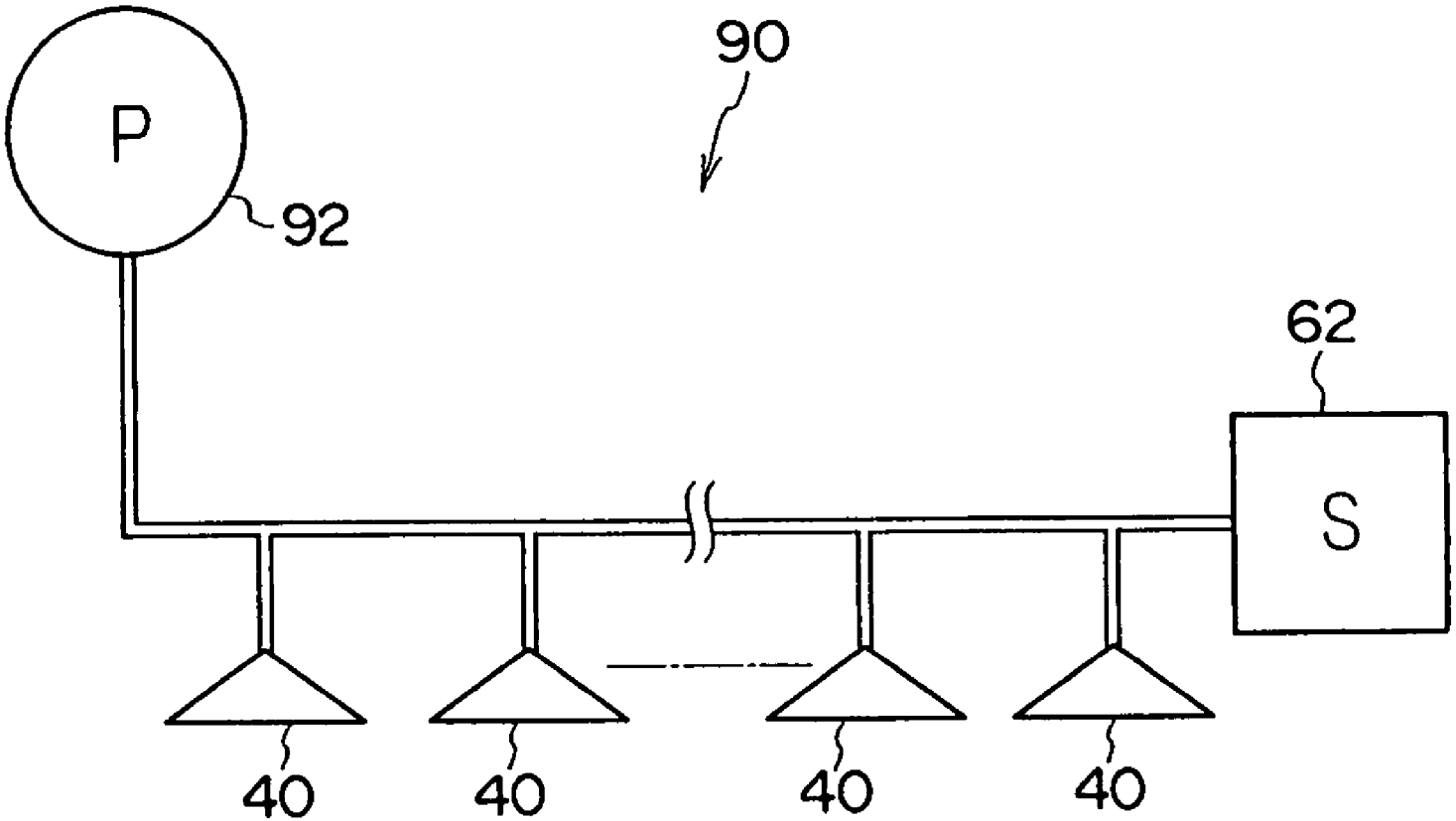
FIG. 5 is an overall structural view of a sucking/removing device relating to a second embodiment of the present invention.

The overall structure of a sucking/removing device 90 relating to a second embodiment is shown schematically in FIG. 5.

The sucking/removing device 90 has basically the same structure as the sucking/removing device 50 relating to the above-described first embodiment. However, in the sucking/removing device 90, the respective suction cups 40 are connected to a vacuum pump 92 which serves as the negative pressure generating source. The vacuum pump 92 is a "DC pump" or an "AC pump". The suction negative pressure of the respective suction cups 40 can be controlled by controlling the voltage (in the case of a "DC pump") or by controlling the frequency (in the case of an "AC pump").

In this way, when the printing plate 12 is sucked and removed by the suction cups 40, the suction negative pressure of the suction cups 40 is detected by the pressure detecting sensor 62, and the suction negative pressure of the suction cups 40 is set to be the first negative pressure $P_1$ which is the minimum pressure required for the suction cups 40 to suck and remove only the uppermost printing plate 12. Further, at the time of conveying/supplying the printing plate 12 after the sucking/removing, the suction negative pressure of the suction cups 40 is set to be the second negative pressure $P_2$ which is required for the conveying/supplying.

In the sucking/removing device 90 relating to the second embodiment and having the above-described structure, as described above, when the interleaf sheet 13 and the printing plate 12 within the cassette 38 are sucked and removed by the suction cups 40, the suction negative pressure of the suction cups 40 is detected by the pressure detecting sensor 62, and the driven state of the vacuum pump 92 is controlled. In this way, the suction negative pressure of the suction cups 40 is set to be the first negative pressure $P_1$ which is the minimum pressure required for the suction cups 40 to suck and remove only the uppermost printing plate 12, and in this state, sucking and removing by the suction cups 40 is carried out. Moreover, at the time of conveying/supplying the printing plate 12 after the sucking/removing, similarly, the suction negative pressure of the suction cups 40 is detected by the pressure detecting sensor 62, and the driven state of the vacuum pump 92 is controlled. In this way, the suction negative pressure of the suction cups 40 is set to be the second negative pressure $P_2$ which is the pressure required for conveying/supplying, and in this state, conveying/supplying by the suction cups 40 is carried out.

Therefore, at the time when the printing plate 12 directly beneath the suction cups 40 (i.e., the uppermost printing plate 12) is sucked by the suction cups 40, the extent to which the printing plate 12 deforms in concave shapes following the configurations of the suction cups 40 can be reduced. Accordingly, it is difficult for a new vacuum to arise between that printing plate 12 and the printing plate 12 therebeneath. It is possible to prevent the printing plate 12 positioned beneath from sticking (i.e., possible to prevent vacuum sticking from arising between the uppermost printing plate 12 and the next printing plate 12 (the printing plate 12 therebeneath)). Namely, the occurrence of plural printing plates 12 being sucked in plural layers together can be reduced.

Accordingly, there is no need in the first place for a suction force which is sufficient to suck plural printing plates 12 (i.e., which is sufficient to even suck plural printing plates 12 together in plural layers), and there is no need to increase the surface area sucked by the suction cups 40 (the size or the number of the suction cups 40), or the capacity of the vacuum pump 92 (the negative pressure generating source), or the like. In this way, the device can be made compact and costs can be reduced.

In this way, in the sucking/removing device 90 relating to the second embodiment, at the time when the uppermost printing plate 12 among a plurality of the stacked printing plates 12 is sucked and removed, the uppermost printing plate 12 can be reliably separated from the next printing plate 12 (the printing plate 12 there beneath) and stably removed, and the surface area sucked by the suction cups 40 (the size or the number of the suction cups 40) and the capacity of the vacuum pump 92 (the negative pressure generating source) can be kept to the minimum needed. It is thereby possible to make the device compact and keep costs low.

Third Embodiment

Figure 6:
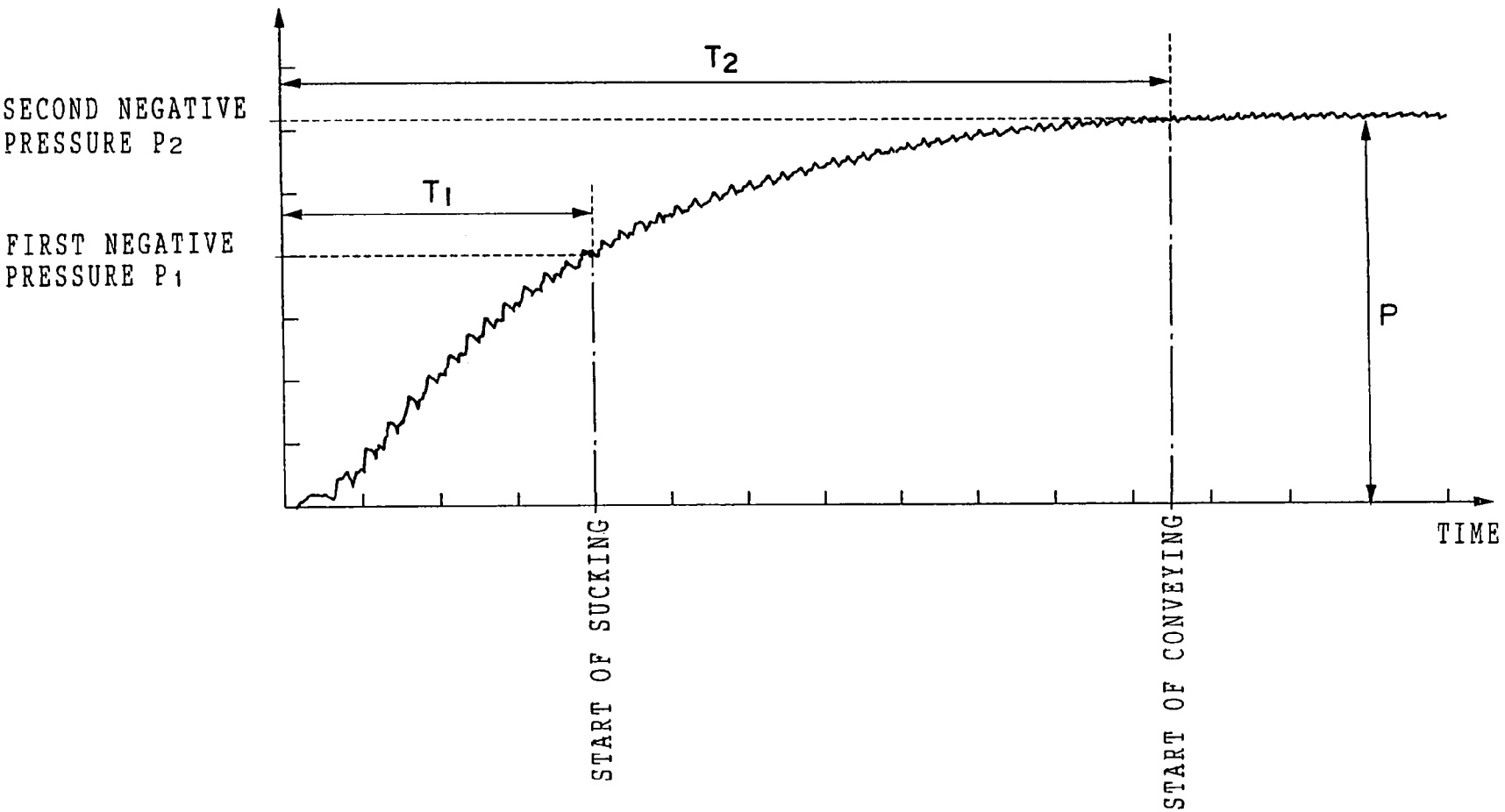
FIG. 6 is a graph showing the state of suction negative pressure of suction cups at the time of sucking/removing and at the time of conveying/supplying in a sucking/removing device (a sucking/removing method) relating to a third embodiment of the present invention.

The state of the suction negative pressure of the suction cups at the time of sucking/removing and at the time of conveying/supplying in a sucking/removing device (sucking/removing method) relating to a third embodiment, is shown as a graph in FIG. 6.

The structure of the sucking/removing device relating to the third embodiment is basically the same as that of the sucking/removing device 90 relating to the above-described second embodiment. The suction cups 40 are connected to the vacuum pump 92 which serves as the negative pressure generating source. As shown in FIG. 6, the vacuum pump 92 can generate a negative pressure P needed for the suction cups 40 to suck/remove the printing plate 12 and convey/supply the printing plate 12.

Here, as shown in FIG. 6, the sucking/removing operation of the suction cups 40 is started immediately at the point in time (time $T_1$) when the suction negative pressure of the suction cups 40 reaches the first negative pressure $P_1$ which is the minimum pressure required for the suction cups 40 to suck and remove only the uppermost printing plate 12. Further, after the sucking/removing, the conveying/supplying of the printing plate 12 is set to start at the point in time (time $T_2$) when the suction negative pressure of the suction cups 40 reaches the second negative pressure $P_2$ which is required for conveying/supplying the printing plate 12.

In the sucking/removing device relating to the third embodiment and having the above-described structure, when the interleaf sheet 13 and the printing plate 12 in the cassette 38 are sucked and removed by the suction cups 40 as described above, the sucking/removing operation of the suction cups 40 is started immediately at the point in time (time $T_1$) when the suction negative pressure of the suction cups 40 reaches the first negative pressure $P_1$ which is the minimum pressure required for the suction cups 40 to suck and remove only the uppermost printing plate 12. In this state, the sucking/removing by the suction cups 40 is carried out. Further, after the sucking/removing, the conveying/supplying of the printing plate 12 is carried out at the point in time (time $T_2$) when the suction negative pressure of the suction cups 40 reaches the second negative pressure $P_2$ which is required for conveying/supplying the printing plate 12.

Therefore, at the time when the printing plate 12 directly beneath the suction cups 40 (i.e., the uppermost printing plate 12) is sucked by the suction cups 40, the extent by which the printing plate 12 deforms in concave shapes following the configurations of the suction cups 40 can be reduced. Accordingly, it is difficult for a new vacuum to arise between that printing plate 12 and the printing plate 12 therebeneath. It is possible to prevent the printing plate 12 positioned beneath from sticking (i.e., possible to prevent vacuum sticking from arising between the uppermost printing plate 12 and the next printing plate 12 (the printing plate 12 therebeneath)). Namely, the occurrence of plural printing plates 12 being sucked together in plural layers can be reduced.

Accordingly, there is no need in the first place for a suction force which is sufficient to suck plural printing plates 12 (i.e., which is sufficient to even suck plural printing plates 12 together in plural layers), and there is no need to increase the surface area sucked by the suction cups 40 (the size or the number of the suction cups 40), or the capacity of the vacuum pump 92 (the negative pressure generating source), or the like. In this way, the device can be made compact and costs can be reduced.

In the sucking/removing device relating to the third embodiment, at the time when the uppermost printing plate 12 among a plurality of the stacked printing plates 12 is sucked and removed, the uppermost printing plate 12 can be reliably separated from the next printing plate 12 (the printing plate 12 therebeneath) and stably removed, and the surface area sucked by the suction cups 40 (the size or the number of the suction cups 40) and the capacity of the vacuum pump 92 (the negative pressure generating source) can be kept to the minimum needed. It is thereby possible to make the device compact and keep costs low.

As described above, the sheet sucking/removing method and the sheet sucking/removing device relating to the present invention have the excellent effects that, at the time of sucking and removing an uppermost sheet among a plurality of stacked sheets, this uppermost sheet can be reliably separated from the next sheet (the sheet therebeneath) and stably removed, and the surface area sucked by the suction cups (the size and the number of the suction cups) and the capacity of a negative pressure generating source can be kept to the minimum needed, and the device can be made compact and costs can be kept low.

What is claimed is:

1. A sheet sucking/removing method for sucking an uppermost sheet among a plurality of stacked sheets, and separating the uppermost sheet from another sheet therebeneath, and removing the uppermost sheet, and conveying and supplying the uppermost sheet to a subsequent process, said method comprising:

carrying out the sucking/removing by a suction device in a first negative pressure state in which a suction negative pressure of the suction device is a minimum pressure needed in order to suck and remove only the uppermost sheet;

after the sucking/removing, carrying out the conveying/supplying by the suction device in a second negative pressure state in which the suction negative pressure of the suction device is a pressure needed for the conveying/supplying; and detecting the suction negative pressure of the suction device by a sensor, wherein setting of the suction negative pressure of the suction device in the first negative pressure state includes a step of opening to the atmosphere by operation of an electromagnetic valve, and setting of the suction negative pressure of the suction device in the second negative pressure state includes a step of controlling at least by the operation of the electromagnetic valve.

2. The method of claim 1, further comprising:

detecting the first negative pressure state and the second negative pressure state by a sensor; and in accordance with results of the detecting, controlling a vacuum pump connected to the suction device.

3. The method of claim 1, further comprising:

starting the sucking/removing immediately at a point in time when the suction negative pressure of the suction device reaches the first negative pressure state; and after the sucking/removing, starting the conveying/supplying of the sheet at a point in time when the suction negative pressure of the suction device reaches the second negative pressure state.

4. A sheet sucking/removing device for sucking an uppermost sheet among a plurality of stacked sheets, separating the uppermost sheet from another sheet there beneath, removing the uppermost sheet, and conveying and supplying the uppermost sheet to a subsequent process, said device comprising;

a suction device provided along a transverse direction of the sheet, and sucking/removing the sheet by negative pressure, and conveying/supplying the sheet;

a negative pressure generating source connected to the suction device, and generating a first negative pressure which is a minimum pressure needed in order for the suction device to suck and remove only the uppermost sheet, and generating thereafter a second negative pressure needed for the conveying/supplying; and a negative pressure controlling device including an electromagnetic valve which is capable of controlling the suction negative pressure of the suction device to a state of the first negative pressure and a state of the second negative pressure, wherein the suction negative pressure of the suction device is controlled to the first negative pressure by the negative pressure controlling device and the sucking/removing is carried out by the suction device, and after the sucking/removing, the suction negative pressure of the suction device is controlled to the second negative pressure by the negative pressure controlling device and the conveying/supplying is carried out by the suction device.

5. The sheet sucking/removing device of claim 4, wherein the negative pressure generating source includes a vacuum pump connected to the suction device via a conduit.

6. The sheet sucking/removing device of claim 5, wherein the negative pressure controlling device further comprises a variable throttle valve equipped with a check valve, and the electromagnetic valve and the variable throttle valve equipped with a check valve are connected to the conduit.

7. The sheet sucking/removing device of claim 6, further comprising a sensor switch which is capable of detecting the first negative pressure and the second negative pressure, and which can operate the electromagnetic two-way type valve.

8. The sheet sucking/removing device of claim 4, wherein the sheet sucking/removing device is applicable to an automatic printing plate exposure device.

9. The method of claim 1, wherein the sucking device comprises one or more suction cups.

10. The sheet sucking/removing device of claim 4, wherein the sucking device comprises one or more suction cups.

* * * * *